United States Patent [19]

Mixon, Jr.

[11] 4,103,984

[45] Aug. 1, 1978

[54] INSULATION DISPLACING PIN CONNECTOR

[75] Inventor: James Lenhart Mixon, Jr., Harrisburg, Pa.

[73] Assignee: AMP Incorporated, Harrisburg, Pa.

[21] Appl. No.: 875,269

[22] Filed: Feb. 6, 1978

Related U.S. Application Data

[63] Continuation of Ser. No. 763,277, Jan. 27, 1977, abandoned.

[51] Int. Cl.[2] ..... H01R 11/20

[52] U.S. Cl. ..... 339/98

[58] Field of Search ..... 339/97 R, 97 P, 97 L, 339/98, 99, 273 R, 273 F, 276 R, 276 D, 276 T

[56] References Cited

U.S. PATENT DOCUMENTS

| | | | |
|---|---|---|---|
| 177,318 | 5/1876 | Barbour | 339/273 R |
| 2,259,261 | 10/1941 | Miller et al. | 339/276 R |
| 3,688,246 | 8/1972 | Toedtman et al. | 339/97 P |

FOREIGN PATENT DOCUMENTS

| | | | |
|---|---|---|---|
| 148,072 | 9/1952 | Australia | 339/97 R |
| 46-6016 | 2/1971 | Japan | 339/97 R |
| 1,198,707 | 7/1970 | United Kingdom | 339/97 R |

*Primary Examiner*—Joseph H. McGlynn
*Attorney, Agent, or Firm*—Allan B. Osborne

[57] ABSTRACT

This invention relates to a device for electrically interconnecting two insulated cables or wires. More particularly the invention includes a wire receiving member and a plurality of insulation cutting and conductor-contacting pins.

1 Claim, 5 Drawing Figures

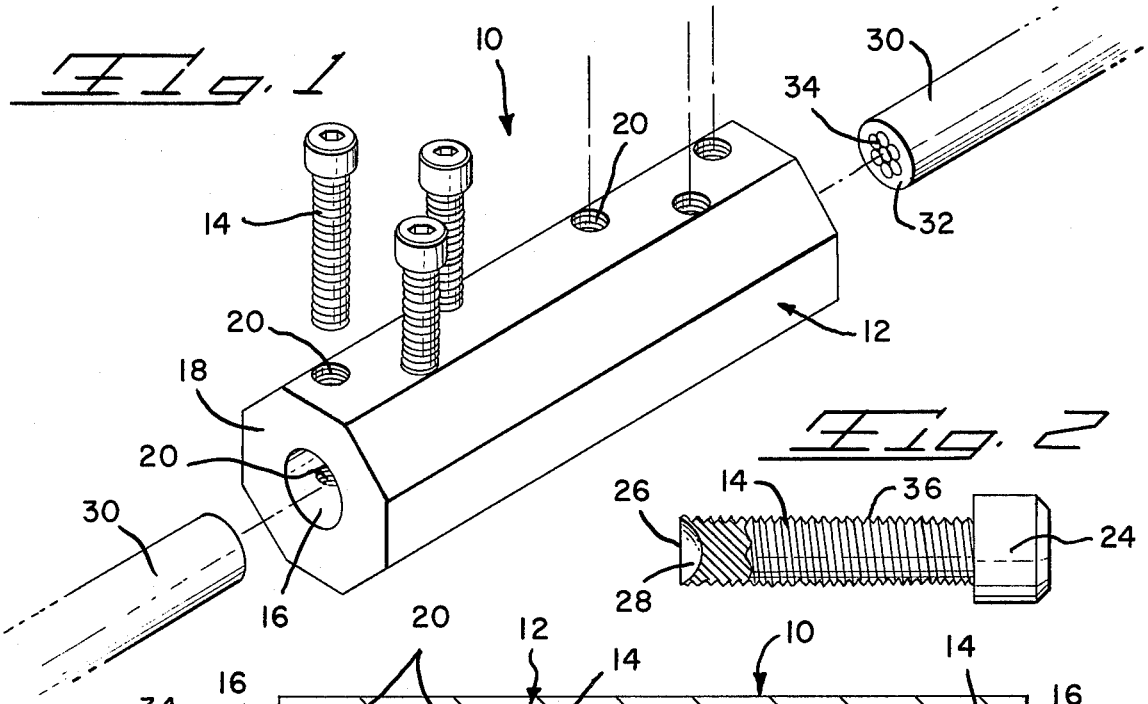
Fig. 1
Fig. 2
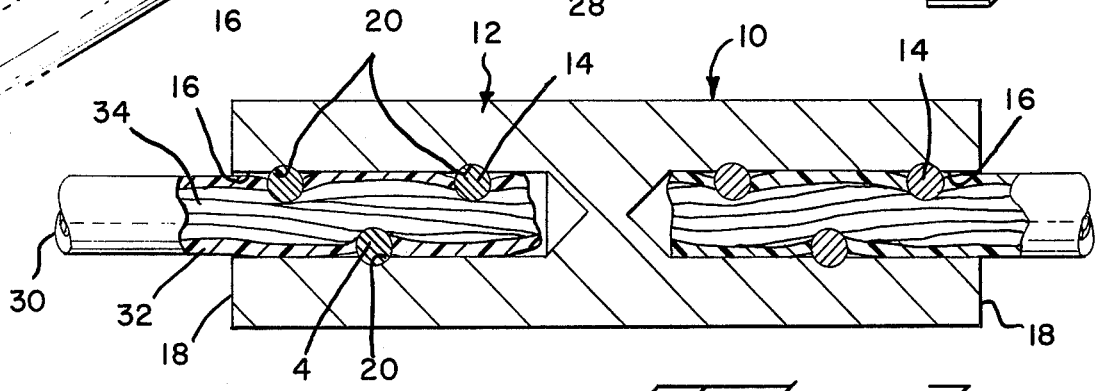
Fig. 3
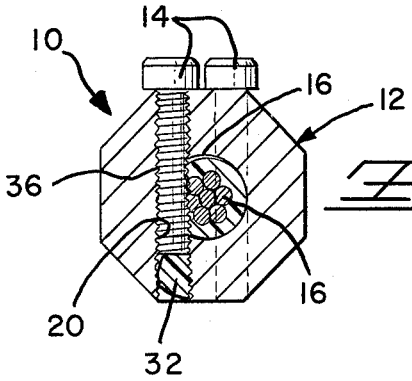
Fig. 4
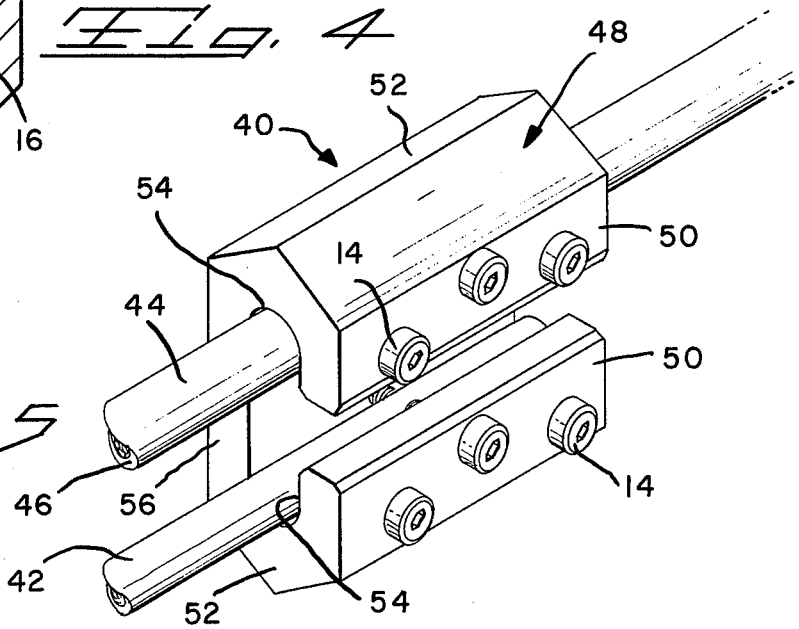
Fig. 5

INSULATION DISPLACING PIN CONNECTOR

This is a continuation of application Ser. No. 763,277, filed Jan. 27, 1977, now abandoned.

BACKGROUND OF THE INVENTION

The utility field; e.g., public electrical distribution companies, require means for interconnecting two electrical cables quickly, simply and preferably without complex or unusual tools. Further, they prefer devices that are economical, reliable and easily transportable.

Accordingly the object of the present invention is to provide a simplistic realistic and economical connector for electrically joining a pair of insulated cables.

BRIEF DESCRIPTION OF THE DRAWINGS

FIG. 1 illustrates a butt splice device incorporating the novelty of the present invention;

FIG. 2 is a side elevational view of a threaded pin of the present invention;

FIG. 3 is a side cross-sectional view of the butt splice device of FIG. 1 demonstrating the electrical joining and mechanical gripping thereof;

FIG. 4 is an axial cross-sectional view of the butt splice device of FIG. 3; and FIG. 5 illustrates another embodiment of the present invention.

DESCRIPTION OF THE INVENTION

The butt splice device 10 of FIGS. 1–4 includes a body member 12 and a plurality of threaded pin members 14.

Body member 12 is preferably an aluminum extrusion although any conductive material and process of manufacturing may be used. An aperture 16 is provided in each end 18 of the body member. The depth of each aperture into the body member approximates two-fifths of the body's length. The aperture's diameter preferably slightly exceeds the diameter of the cables to be received therein.

A plurality of threaded bores 20 are provided in the body member. These bores are normal to the body member's longitudinal axis and intersect apertures 16. The preferred pattern of bores 20 is three for each aperture with two positioned on one side thereof and the third on the other side and spaced longitudinally between the other two. This staggered arrangement is clearly shown in FIG. 3.

Pins 14 have a threaded shank 22 with a head 24 at one end and a cutting edge 26 at the other end. Head 24 may be any conventional bolt head having means thereon for rotating the pin in bore 20. Cutting edge 26 is formed by hollowing out the end of the shank thereby providing a concave and as indicated by reference numeral 28 in FIG. 2. In this manner a sharp cutting edge is provided about the entire circumference of the shank.

The utilization of butt splice 10 does not require any particular skill or special tools. A cable 30 is inserted into an aperture 16 with its insulation jacket 32 intact. Holding the inserted cable and body member 12 firmly, pins 14 are threaded into the bores 20 which intersect the cable-containing aperture. Upon engaging the cable, cutting edge 26 cuts into and removes a segment of insulation 32. As shown in FIG. 4, the segment is pushed ahead of the pin. The cutting edge further contacts the cable's conductor, which may consist of a single strand but more commonly multiple strands 34. In doing so, the contacted strands are scraped so that as the pins are further advanced, the threads 36 on the shanks engage clean metal. As is well known, clean metal provides a better electrical connection.

The cross-sectional view of butt splice 10 shown in FIG. 3 demonstrates the mechanical gripping provided by the staggered pin pattern.

FIG. 5 illustrates a tap connector 40 useful for connecting a drop wire 42 to a main line cable 44 without the need for removing insulation 46. The connector 40 consists of a C-shaped body member 48 and a plurality of pins 14. A plurality of bores 20 are located in each short leg 50 which in cooperation with bights 52 provide two grooves 54. The pattern of the bores are staggered and they also extend through the back connecting side 56 of the C-shaped body member 48.

In use, the body member 48 is first hooked over the main line cable 44 and pins 14 installed to mechanically secure that cable to the member. The drop wire 42 is then laid into the upwardly facing groove 54 and secured therein by pins 14. Electrical connection is made in the same manner as described with respect to butt splice device 10.

In summary, the present invention provides means for interconnecting two cables without the need to remove insulation. The method used is such that the cable conductors are automatically scraped and cleaned. The staggered pin pattern provides residual pressure in the cables to mechanically retain such in the body member. The method further enhances the mechanical connection in that the pressure is directly on the conductors and not on the insulating jacket which would have a tendency to creep. The application requires simple tools in that low torquing forces are needed. The body members illustrated as well as those which others may design utilizing the concepts of the present invention are economical and are mobile. Further the body members and pins are easily susceptable to pre or post insulating.

The foregoing detailed description has been given for clearness of understanding only, and no unnecessary limitations should be understood therefrom, as some modifications will be obvious to those skilled in the art.

What is claimed is:

1. An insulation displacing pin connector for interconnecting two electrical cables, comprising:

a. a body member of conductive material having cable-receiving apertures at either end thereof;

b. a plurality of threaded bores positioned in the body member with three bores intersecting each aperture with two of the three being on one side of the aperture and the third being on the opposite side and longitudinally between the first two;

c. a plurality of conductive pins having a threaded shank with the free end of the shank being hollowed out to define a frontal cutting edge.

so that as the pins are threadedly advanced into a bore, the frontal cutting edge cuts through the insulation on a cable which may be positioned in the aperture and scrapes the edge of the underlying conductor and as the pins are further advanced, the threaded shanks electrically and mechanically engage peripherally the conductor on both sides thereof.

* * * * *